US009636842B2

(12) United States Patent
Foppe

(10) Patent No.: US 9,636,842 B2
(45) Date of Patent: May 2, 2017

(54) CONCRETE BLOCK PRODUCING DEVICE AND METHOD FOR PRODUCING AT LEAST TWO-COLOURED CONCRETE BLOCKS

(75) Inventor: Norbert Foppe, Spelle (DE)

(73) Assignee: REKERS VERWALTUNGS-GMBH & CO. KG, Spelle (DE)

( * ) Notice: Subject to any disclaimer, the term of this patent is extended or adjusted under 35 U.S.C. 154(b) by 643 days.

(21) Appl. No.: 14/124,841

(22) PCT Filed: Jun. 4, 2012

(86) PCT No.: PCT/EP2012/060521

§ 371 (c)(1),
(2), (4) Date: Jan. 27, 2014

(87) PCT Pub. No.: WO2012/168197

PCT Pub. Date: Dec. 13, 2012

(65) Prior Publication Data

US 2014/0138876 A1 May 22, 2014

(30) Foreign Application Priority Data

Jun. 9, 2011 (DE) ..... 10 2011 050 974

(51) Int. Cl.
*B28B 13/02* (2006.01)
*B30B 15/30* (2006.01)

(52) U.S. Cl.
CPC ..... *B28B 13/02* (2013.01); *B28B 13/022* (2013.01); *B28B 13/023* (2013.01); *B30B 15/302* (2013.01)

(58) Field of Classification Search
CPC ..... B28B 13/02; B28B 13/022; B28B 13/023
See application file for complete search history.

(56) References Cited

U.S. PATENT DOCUMENTS 4,153,401 A * 5/1979 Longinotti ..... B28B 13/022 425/130
6,382,947 B1 * 5/2002 Bryant ..... B01F 5/265 425/130

(Continued)

FOREIGN PATENT DOCUMENTS

EP 0605930 A1 7/1994
EP 0962294 A2 * 8/1999

(Continued)

OTHER PUBLICATIONS

PCT International Search Report and Written Opinion dated Oct. 1, 2012 issued on corresponding PCT International Patent Application No. PCT/EP2012/060521.

*Primary Examiner* — James Sanders
(74) *Attorney, Agent, or Firm* — Day Pitney LLP

(57) ABSTRACT

The invention relates to a concrete block producing device and to a method for producing colored concrete blocks using a concrete block producing device including a block molding machine with a block mold that can be supplied with fresh concrete from a concrete hopper. The concrete hopper can be supplied with portions of at least two differently colored fresh concretes in a controlled manner by a dosing device. The dosing device includes at least two dosing chambers and a transport device for transporting the differently colored fresh concrete portions to the concrete hopper. The transport device includes at least one positioning unit for guiding the colored fresh concrete from the dosing chambers to the concrete hopper. The positioning unit is designed to supply defined positions in the concrete hopper with differently colored fresh concrete portions.

16 Claims, 3 Drawing Sheets

(56) References Cited

U.S. PATENT DOCUMENTS

| | | | | |
|---|---|---|---|---|
| 6,923,565 | B2 * | 8/2005 | Johnson | B28B 13/027 366/10 |
| 2006/0237008 | A1 | 10/2006 | Lulla et al. | |

FOREIGN PATENT DOCUMENTS

| | | | |
|---|---|---|---|
| EP | 0962294 | A2 | 12/1999 |
| WO | WO-2006/116332 | A2 | 11/2006 |

* cited by examiner

CONCRETE BLOCK PRODUCING DEVICE AND METHOD FOR PRODUCING AT LEAST TWO-COLOURED CONCRETE BLOCKS

CROSS-REFERENCE TO THE RELATED APPLICATION

This application is a U.S. national stage application under 35 U.S.C. 371 of International Application No. PCT/EP2012/060521, filed Jun. 4, 2012, which claims priority to and the benefits of German Patent Application No, 10 2011 050 974.7, filed Jun. 9, 2011, each of which is incorporated by reference herein in its entirety.

BACKGROUND OF THE INVENTION

The invention relates to a concrete block producing device with a block machine having a stone mould that can be fed with fresh concrete from a concrete hopper, wherein the concrete hopper can be filled with portions of at least two differently coloured fresh concretes from a dosing device in a controlled manner and the dosing device has at least two dosing chambers and a transport device to transport the differently coloured fresh concrete portions into the concrete hopper. Further, the invention relates to a method for producing at least two-coloured concrete blocks using such a concrete block producing device according to the invention.

Concrete block producing devices are for the mass production of various parts of concrete like for building construction and/or underground construction, but also for landscaping and/or gardening. The product range of the concrete blocks comprises concrete slabs, paving blocks, curbstones, gutters, and ornamental stones, among others.

Generally, concrete block producing devices as a central plant component have a block machine. Depending on the embodiment these have one or more concrete hoppers. The fresh concrete can be filled from the respective concrete hopper into the stone mould via a feedbox in order to then be packed by means of a vibrator table and a tamper. After the packing operation the product is demoulded and taken out of the block machine on a bolster pallet via a conveyor device.

Concrete blocks that should have a special quality, in particular visual impression, generally consist of a coarse mix layer and an overlying cover layer of facemix that can and should, respectively, form the visible upper surface in the end product. Here, in particular the visible upper surface of a concrete block should often be like the structure and colouring of natural stones. Since the colour pallet of natural stones has a large range a colouring of the concrete stone corresponding to a natural stone requires dyeing of the concrete with different colours. Colours that often occur in nature are black, white, yellow, red, and blue as well as their mixes and shades. In order to fulfill the high customer needs and to generate manifold colour compositions on the concrete stone surfaces several processing stages such as mixing, dosing, and transport must be set.

Generally, a concrete block producing device in addition to at least one block machine has also at least one mixing device for mixing the concrete and generally at least one transport device such as a bucket conveyor plant, a belt conveyor, or the like to transport the fresh concrete from the mixing plant to the block machine or to a dosing device for the fresh concrete. If the device should generate coloured concrete blocks the colour pigments or suitable aggregates are generally admixed to the fresh concrete in the mixing device such that the mostly rather grey colour of the concrete is dyed in a desired colour. In this way, differently coloured concretes can be produced.

In WO 2006/116332 A2 such a generic device and a generic method, respectively, for controlled colour distribution in mass-produced concrete blocks are described, wherein differently coloured fresh concrete portions are specifically inserted into a facemix hopper by means of a dosing and transport device. Here, the dosing device according to WO 2006/116332 A2 has six different dosing chambers storing differently coloured fresh concretes, but wherein also devices with less or more dosing devices are either already known or conceivable. This successively doses the differently coloured fresh concrete portions onto a belt conveyor or simultaneously onto each other if these should already get mixed on the belt conveyor. With the help of this first belt conveyor, also referred to as mixing conveyor, the differently coloured fresh concrete portions are conveyed to a second belt conveyor, the so-called ascending conveyor. Its higher end extends beyond the facemix hopper and is for filling the same. In order to selectively position the differently coloured concrete portions in the hopper the ascending conveyor can be swiveled in a substantially horizontal plane about a vertical axis. Thus, with a central control system various colour patterns can be generated.

This known concrete block producing device is excellent for the production of coloured concrete blocks that should look like natural stones. In particular, it is possible with it to generate exceptionally realistic shades in the concrete blocks. However, it requires relatively large space for the dosing device with its adjacent transport device and is relatively expensive in its manufacture.

SUMMARY

Against this background it is the object of the invention to develop a more space saving and more cost effective concrete block producing device as well as a method for producing coloured concrete blocks that enables a more space efficient and more cost effective production.

This problem is solved with a concrete block producing device and a method according to the present invention. Advantageous developments are given in the dependent claims.

The concrete block producing device according to the invention differs from the known concrete block producing device in that the transport device has at least one positioning means (14) for receiving and guiding the coloured fresh concrete from the dosing chambers into the concrete hopper that is at least partially arranged at or in the concrete hopper (3, 4), wherein the positioning means is designed such that it can feed differently coloured fresh concrete portions at predetermined positions in the concrete hopper. For that, the positioning means can for example be designed as a boat-like car or slide with a flap at the bottom. So, at predetermined positions the concrete hopper is fed with the respective fresh concrete portions by opening the flap. However, it is also possible to employ a tiltable positioning means to feed the concrete hopper with fresh concrete portions. Thus, despite a very simple and space saving configuration a visually appealing and realistic shade of the generated concrete blocks can be achieved.

Preferably, the positioning means is configured as an at least partially downwardly extending positioning duct the hopper side facing end of which can be positioned above the internal base area of the hopper by a movement lying substantially in a vertical plane to feed differently coloured fresh concrete portions at predetermined positions in the concrete hopper. The so far rather flat configuration of the device is replaced by a solution approach building up into height, wherein at least the central ascending conveyor and the mixing conveyor of WO 2006/116332 A2 are replaced by a positioning duct.

Here, by the internal base area there is understood the base area that is restricted by the walls of the respective hopper. Moving the hopper-side positioning duct in a substantially vertical plane means that the positioning duct cannot only be moved over one side of the hopper, but also over the entire internal base area. In this way, also larger sized hoppers such as coarse mix hoppers can be selectively filled with a positioning tube, preferably fixed above the center of the hopper by moving the hopper-side tube end at each position of the internal base area.

The configuration according to the invention has the advantage that the transport device is at least partially oriented downwards, preferably vertical and no longer substantially horizontal as in the prior art. In this way, the fresh concrete received by the dosing chamber can be filled into the concrete hopper along the positioning duct by means of gravity. That means, that for the transport of a dosing chamber to the concrete hopper in the best case no conveyor means is required. At the same time, the device is much more compact, since no long belt conveyors must be swiveled in a horizontal plane any more. Also, the production is more cost-effective, since one duct is markedly cheaper than a plurality of belt conveyors. Moreover, the relatively complicated regulation known from the prior art is omitted, since the coordination of the operation of the mixing belt conveyor and the ascending conveyor is omitted.

According to the development of the invention the dosing device is arranged above the concrete hopper fed by it at the block machine. By arranging the dosing device with at least two dosing chambers above the concrete hopper to be fed in the lined-up surface area there can be saved space. In particular, if the dosing chamber outlets are directly arranged above the upper end of the positioning duct also a further duct and/or conveyor means in addition to the positioning duct is no longer required.

The dosing chambers can be modularly built in at suitable attachment points on the main frame of the block machine above the respective hopper. Thus, as needed a two-chamber dosing device or a three-chamber dosing device, for example can be directly arranged at the block machine.

Similar to the horizontal mixing belt conveyor known from the prior art explained above with the dosing chambers arranged according to the invention mixing of different concrete portions can already take place during transport. However, in contrast to WO 2006/116332 A2, this can happen by simultaneously opening at least two dosing chambers. In order to establish the wanted mixture the respective concrete portions must be transferred to the transport device at the same time.

In the simplest case, the positioning duct can be configured as a pipe or flexible tube. Also, the positioning duct can be fixed at its end turned away from the concrete hopper and configured as telescopic pipe and/or as a pipe that can be swiveled about a fixed point. In this way, in swiveling or moving the positioning duct, respectively, its end can be moved along a horizontal axis. Preferably, the fixture is centered with respect to the base area of the concrete hopper. A flexible tube has the advantage that it is cost-effective and its end can relatively easily be moved by deforming the tube. However, a possible deformation should not interfere with the transport behavior of the fresh concrete mass in the positioning duct.

Suitably, the diameter of the positioning duct at the hopper-side end is made smaller than the width of a conventional belt conveyor. Thereby, the concrete hopper can more selectively be filled than with a wide belt conveyor. However, the choice of the diameter of the positioning duct is limited by the fact that a sufficient flow of material should be ensured. By the choice of a certain diameter like in hourglasses the flow rate of the fresh concrete can be restricted. A low flow is of advantage so that a too strong "fresh concrete jet" that could result in a separation or pre-package, respectively of the fresh concrete or an intermixture of differently coloured concrete heaps cannot develop.

If a narrow concrete hopper is filled the positioning duct can be sized such that the pipe diameter is smaller than or equal to the short side of the hopper. With this sizing, only a horizontal movement of the positioning duct end is sufficient to be able to fill the internal base area with different fresh concrete portions.

It is suitable, if at least one guiding member is arranged at the hopper-side end of the positioning duct that can be moved in a horizontal guide attached in or at the concrete hopper. For example, the guide can be a shaft or the like.

A guide of the positioning duct on the hopper-side end is particularly advantageous with the use of a flexible tube. By the fixture at a horizontal guide attached in or at the concrete hopper movements occurring during the material flow through the positioning duct can be compensated and unwanted incorrect positionings can be prevented.

The horizontal guide may also be provided in the hopper inner wall in the form of horizontal guiding gaps such as grooves or guiding lugs. The position of the horizontal guide restricts the maximum filling level of the hopper. The deeper the positioning duct protrudes into the hopper the lower the dosing chambers to be arranged above it can be installed.

According to a development of the invention the guiding member is formed as a slide at the hopper-side end of the positioning duct. A slide can simply be placed on a hopper, so that the edge of the hopper itself can be used as a horizontal guide.

For generating the movement of the positioning duct a suitable, in particular electric, pneumatic, or hydraulic drive should be provided. This, in the simplest variation can generate a simple linear movement, for example by retracting and extending a piston, respectively, and may be controlled by a controller. However, in particularly simple embodiments basically also a drive by hand is conceivable.

Suitably, the transport device at at least one dosing chamber has a feeder duct with which the fresh concrete from the respective dosing chamber or the dosing chambers can be introduced into the positioning duct. Here, in an advantageous space saving arrangement several feeder ducts can be guided radially to the positioning duct and end above or in it. Thus, a closed connection between dosing chambers, feeder ducts, and positioning duct can be established.

Alternatively, at the upper end the positioning duct has a funnel for receiving the fresh concrete. Then, the feeder ducts preferably end above the funnel and there is an open connection wherein the concrete portions fall from the feeder ducts into the funnel. This variant is easy to clean. According to the size of the funnel several portions can be taken up from the dosing devices and/or the feeder ducts at the same time. The conicity of the funnel enables a selective deceleration of the material flow and promotion of a possible intermixture. On the one hand, the funnel can be formed open at the top or with a cap having openings depending on the number of dosing chambers and the respective feeder ducts, respectively. Moreover, other embodiments for closed connectors and adapters are possible.

As a further development, the positioning duct is directly or indirectly attached to a frame of the block machine. Preferably, the frame is the stable main frame of the block machine. If a funnel is present the positioning duct is preferably directly attached to the frame of the machine via the funnel, namely at the lower part of the funnel above the concrete hopper. If a swivelable pipe is used as the positioning duct a driving unit for moving the pipe can be attached to the attachment or fixed point, respectively.

According to a development of the invention the dosing chambers have dosing means that are especially formed as slidable and/or swivelable closing means. For example, as the slidable closing means horizontal sliding surfaces, flaps, swivelable single or double shells are conceivable that can close the dosing chambers and correspondingly partially open the opening for the desired dosing rate in a simple manner. Preferably, the closing means are attached to the dosing chamber bottom either on one side or both sides. In this way, simply by gravity the coloured concrete material can be fed from the dosing chamber into the subjacent positioning duct.

As a further development a feeder duct is formed as a belt conveyor and/or pipeline. The feeder ducts may be configured both horizontal and inclined. Preferably, the configuration as a belt conveyor can also be used as a feed-regulating conveyor, so that the desired portions can be inserted from the dosing chamber into the positioning duct via the feeder duct.

Preferably, the feeder ducts have conveyor means, in particular worm drive, rotor, pushers, and/or pistons. For the optimum conveyance of the coloured fresh concrete portions the diameter of a screw or a piston is matched with the internal diameter of the pipe cylinder of the feeder ducts. In the use of screw conveyors it is also possible to configure two feeder ducts as one duct with a central outlet or outlets. Here, a single shaft with counterturning screws is sufficient to convey two differently coloured fresh concretes. If it is not intended to convey from both dosing chambers with the common feeder duct at the same time a closing means can prevent the feed from one of the two chambers.

Preferably, the drives of the respective pushers, pistons, or screws are attached outside the feeder ducts. Here, the driving unit is preferably attached to the feeder duct such that it is swivelable to provide an easy cleaning or replacement of the inner conveyor means.

According to a development of the invention the dosing device and/or the transport device have a nonstick coating at at least one contact surface between the fresh concrete and the respective device. In this way, the material flow is improved and adhesion of fresh concrete residues to the dosing chamber inner walls and the duct inner walls, respectively, is prevented. Moreover, a self-cleaning effect is achieved or thus, an easy cleaning of the construction elements is made possible. This, after emptying a dosing chamber enables a fresh concrete of a different colour to be sequentially inserted into the same dosing chamber. Here, preferably similar shades of colour should sequentially be fed into the same dosing chambers. By repeatedly using individual dosing chambers less construction elements are required, so that the correspondingly designed concrete block producing device is not only more compact, but also more cost-effective.

As mentioned above, the invention also provides a method for producing coloured concrete blocks using a concrete block producing device according to the invention. This method includes the following steps:

- moving a positioning means, in particular a positioning duct, at or in the concrete hopper for selectively receiving and guiding coloured fresh concrete portions from dosing chambers into a concrete hopper, wherein preferably the hopper-side end of the positioning duct is moved in a substantially vertical plane above the internal base area of the concrete hopper;
- dosing at least one fresh concrete portion and transporting the same into the positioning means.

By moving the hopper-side end of the positioning duct in a substantially vertical plane the positioning can take place over the entire internal base area of a concrete hopper at predetermined positions, preferably by means of gravity. Moreover, the positioning and dosing operation can be repeated until the concrete hopper is filled with coloured fresh concrete up to a predetermined level.

Usefully, the predetermined level should at least correspond to the feedbox height. However, it can also be chosen slightly larger to ensure the complete filling of the feedbox. The feedbox is directly connected to the bottom of the concrete hopper, so that the filling can be done directly into the feedbox if a closing means at the bottom of the concrete hopper is in the open position.

Furthermore, the method according to the invention has the opportunity to generate different colour patterns by varying the order and/or duration of the dosing operation and/or by mixing at least two coloured fresh concretes by simultaneously dosing from at least two dosing chambers. Also, different colour patterns can be generated by varying the position of equally coloured fresh concrete portions in the concrete hopper. Moreover, by simultaneously controlling at least two of the dosing chambers mixing of the coloured fresh concretes in the positioning duct and/or in the funnel of the positioning duct is possible. In this way, a plurality of design options of the concrete block surface with realistic coloured stone mould surfaces is given, so that repeating stripes, spots, or marbled patterns can be produced. Finally, further surface colour schemes with random colour patterns or even repeating patterns can be produced.

Preferably, different colour patterns are produced by varying the positions of the coloured fresh concrete portions in the concrete hopper. The different positions provide for an irregular colour scheme.

Controlling the dosing and positioning, respectively, can be done centralized by a central processing unit. A memory unit of the central processing unit can be used as a database to selectively and repeatedly generate colour patterns.

BRIEF DESCRIPTION OF THE DRAWINGS

In the following, the invention is explained in more detail with the help of drawings of an exemplary embodiment. In the drawings, same elements have the same reference numbers. Here.

DETAILED DESCRIPTION

Figure 1:
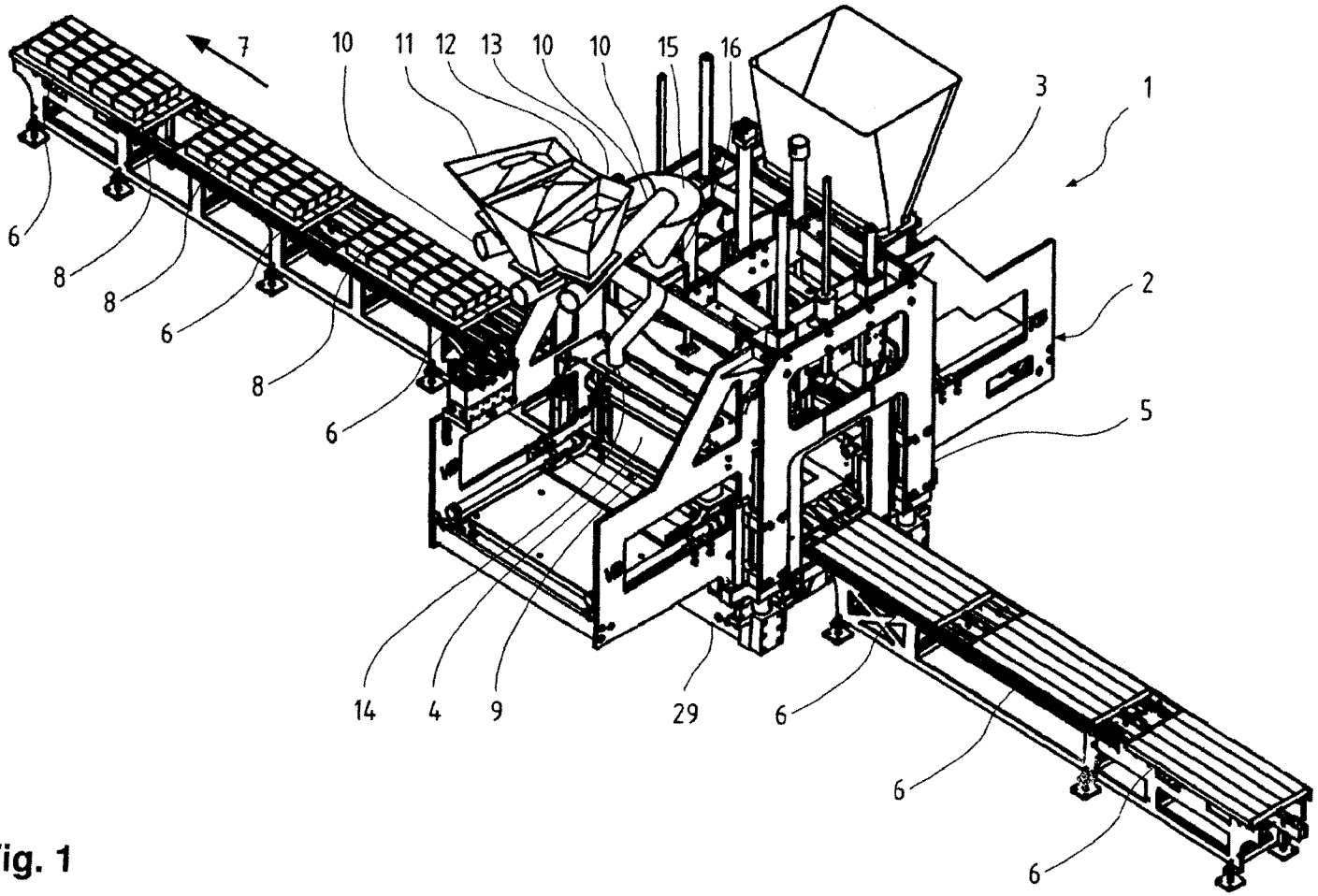
FIG. 1 schematically shows a perspective view of a part of a concrete block producing device according to the invention.
Figure 2:
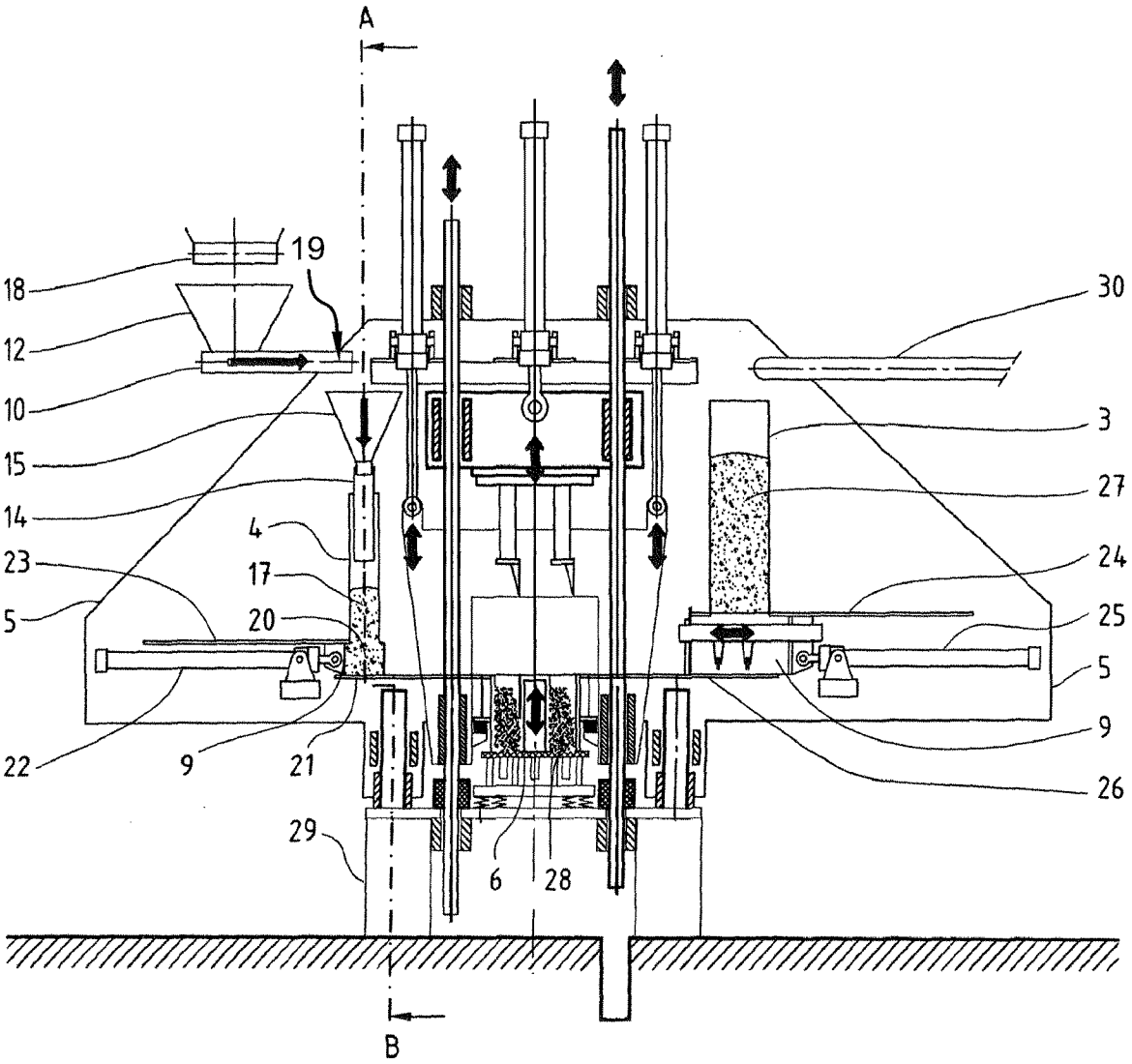
FIG. 2 schematically shows a cross-section through the concrete producing device shown in FIG. 1.
Figure 3:
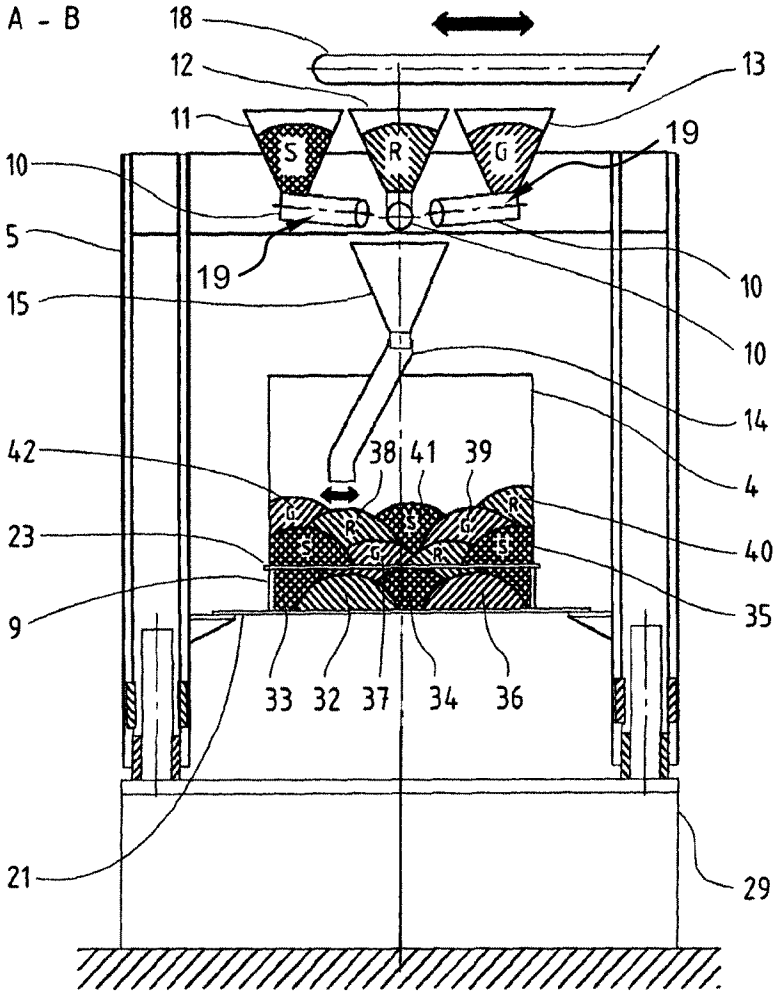
FIG. 3 schematically shows a longitudinal section through the concrete producing device shown in FIG. 1 with the dosing and transport device being illustrated.

The concrete block producing device 1 shown in FIG. 1, FIG. 2, and FIG. 3 comprises a block machine 2 with a main frame 5 supported on a static frame 29 and having laterally arranged a coarse mix hopper 3 and a facemix hopper 4. Since the facemix is generally applied to the coarse mix as a thin cover layer the facemix hopper 4 has a smaller volume than the coarse mix hopper 3.

Below the concrete hoppers 3, 4 is arranged a feedbox 9 for each. In FIGS. 1 and 2, the feedbox 9 of the facemix hopper in the retracted stage is located below the open closing sheet of the facemix hopper 23 illustrated in more detail in FIG. 2, so that the facemix 17 is let through into the feedbox 9.

The filled facemix and coarse mix feedboxes on both sides each with a hydraulic cylinder 22 and 25, respectively (see, FIG. 2) can be pushed to a vibrator table centrally arranged in the block machine 2 via a stone mould for filling the same. After the product has finished, the moulded articles 8 that are on a bolster pallet 6 can be transported from the block machine 2 in the production direction 7 via a conveyor device.

Above the facemix hopper 4 a dosing device with three dosing chambers 11, 12, 13 for one coloured fresh concrete each is arranged, so that the addition of up to three different colours is possible. Via three feeder ducts 10 the coloured fresh concrete portions from the dosing chambers reach a positioning duct 14 via the funnel 15. Its lower end can be selectively moved in the facemix hopper 4 to selectively position differently coloured fresh concrete portions therein. At the junction of the funnel 15 to the positioning duct 14 the latter is directly attached to the main frame 5.

Here, the dosing of the desired fresh concrete amount is made by conveyor means such as screws arranged within the feeder ducts 10 and driven via driving units 19.

Also, positioning of the positioning duct is made via a driving unit (not shown). For that, the lower end of the positioning duct is preferably connected to a drive that can move the end of the positioning duct in a horizontal direction along the long side of the facemix hopper 4. That is, the positioning duct 14 is substantially moved in a vertical plane along the longitudinal axis of the hopper that in this example extends parallel to the production direction 7. However, it is basically conceivable that the plane also extends in other angular positions such as rectangular to the production direction. In this way, the end of the positioning duct 14 can be positioned over the entire width and long side of the hopper 4, respectively.

FIG. 2 shows a section through the block machine along the center of the dosing chamber 12. The dosing chamber 12 for conveying the material flow downwards is conically configured and has a feeder duct 10 at the chamber bottom. The arrow in feeder duct 10 indicates the conveying direction of a conveyor means, here not illustrated in detail, that can be configured as a pusher, piston, or screw.

The coloured fresh concrete to be dosed reaches the dosing chambers 12, 13, 14 via a bucket conveyor or, as shown here, a belt conveyor 18. The conveyer unit 18 transports already pre-mixed coloured fresh concrete, wherein the addition of the colour or aggregates is made before in known (not shown) mixing devices.

A further conveyor device is located on the opposite side of the block machine 2 above the coarse mix hopper 3 that can be closed in the lower part with a closing sheet 24. Here, this is formed as a belt conveyor 30 for the coarse mix 27 and brings this directly to the coarse mix hopper 3. Also on this side there can optionally be arranged dosing devices (not shown) with a positioning duct for adding differently coloured coarse mixes.

The facemix 20 let through from the facemix hopper 4 into the feedbox 9 is filled into a stone mould via the table board 21. Similarly, the coarse mix is filled into a stone mould via the corresponding coarse mix table board 26. Here, the sequence of motions should be optimized such that the arrangement of the coloured fresh concrete portions established in the facemix hopper by the dosing and the positioning duct and also in the concrete of the stone mould 28, if possible, remains largely unchanged.

In order to maintain the arrangement and layering of the coloured fresh concrete portions, respectively, despite the feedbox travel it is preferred that the feedbox 9 is completely located below the facemix hopper 4 and above the stone mould, respectively, before the closing sheet 23 is opened and the stone mould is filled, respectively. Moreover, to prevent further mixings when the fresh concrete portions fall into the feedbox 9 a vertical arrangement of the walls as well as rounded edges of the facemix hopper 4 and the feedbox 9 are advantageous.

The smaller the hopper 3, 4 is in size, the less intermixings occur during the vertical transport of the hopper contents. Thus, it is preferable to use small facemix hopper volumes. Moreover, it is advantageous in this design that the fresh concrete mixture does not rest long in the concrete hopper 4 and thus, remains wet as well to keep it less intermixed than in conventional large concrete hoppers. Possible measures of the internal base area of the facemix hopper 4 are about 1 m×0.25 m.

The entire plant can be controlled by a central processing system (not shown). So, both refilling processes of the dosing chambers 11, 12, 13 and the dosing itself and the positioning of the positioning duct 14 can be centrally controlled. In particular, for a specific colour scheme it is required to control dosing and positioning of the positioning duct 14.

FIG. 3 shows a sectional view along the intersection line A-B shown in FIG. 2 with a detailed illustration of the dosing and transport device. The facemix hopper 4 is centrally arranged on the facemix table board 21. Above, there is arranged the feedbox 9 that is upwards restricted by the closing sheet 23. The positioning duct 14 protrudes into the facemix hopper 4 and can be moved at its hopper-side end horizontally (see, double arrow) along the entire width of the facemix hopper 4.

At the upper end of the positioning duct 14 a funnel 15 for receiving coloured fresh concrete portions from the feeder ducts 10 is arranged. The first dosing chamber 11 is filled with a black fresh concrete S, the second dosing chamber 12 is filled with red fresh concrete R, and the third dosing chamber 13 is filled with yellow fresh concrete G. These coloured concretes are inserted into the dosing chambers via the belt conveyor 18. Here, the end of the belt conveyor 18 can be horizontally moved (see, double arrow) to feed the respective dosing chamber to be refilled.

According to FIG. 3, the coloured fresh concrete portions are directly divided into portions into the feedbox 9 on the table board 21. Alternatively, the addition may also be carried out onto the closed closing sheet or with a higher filling level also above thereof.

Reference numbers 31 to 41 indicate a possible order of the additions and positions of the fresh concrete portions. The order of additions shown in FIG. 3 starts with the positioning of the hopper-side end of the positioning duct on the right side of the hopper, so that at position 31 a yellow fresh concrete portion G is arranged. Subsequently, by horizontally (see, double arrow) swiveling of the positioning duct to the left the red fresh concrete is supplied at position 32.

To selectively fill position 33 the position of the end of the positioning duct shown in FIG. 3, that is located near the left sidewall of the facemix hopper 4, is adjusted. This adjustment generates a black fresh concrete portion S. 33, that is restricted by the lateral feedbox wall and facemix hopper wall and overlaps a part of the red predecessor fresh concrete heap R, 32. In comparison to the previous additions the duration of the addition is longer, so that here, a larger amount of black fresh concrete S is added and the level of the predecessor portions as well as the level of the feedbox 9 is exceeded.

The further portionings are made in the same way by positioning the hopper-side end of the positioning duct 14. Here, by at least two fillings at the same position overlying colour heaps are produced. After the entire feedbox level has been filled by the selective fillings, the closing sheet can be closed and then, the feedbox 9 can be moved to the stone mould filling position. It can only be filled up to the level of the red fresh concrete portion at the right position 40, so that a small distance to the duct end of the positioning duct 14 is maintained to prevent intermixings by the motion of the duct end.

LIST OF REFERENCE NUMBERS

1 Concrete Block Producing Device
2 Block Machine
3 Coarse Mix Hopper
4 Facemix Hopper
5 Main Frame
6 Bolster Pallet
7 Production Direction
8 Moulded Article
9 Feedbox
10 Feeder Ducts
11 First Dosing Chamber
12 Second Dosing Chamber
13 Third Dosing Chamber
14 Positioning Duct
15 Funnel
16 Funnel Fixture
17 Facemix
18 Conveyer Unit to the Facemix Hopper
19 Driving Unit
20 Facemix in the Feedbox
21 Table Board Facemix
22 Hydraulic Cylinder of the Facemix Feedbox
23 Closing Sheet of the Facemix Hopper
24 Closing Sheet of the Coarse Mix Hopper
25 Hydraulic Cylinder of the Coarse Mix Feedbox
26 Coarse Mix Table Board
27 Coarse Mix
28 Concrete in Stone Mould
29 Static Frame
30 Belt Conveyor to the Coarse Mix Hopper
31-42 Different Positions of the Fresh Concrete Portions
S Black Fresh Concrete
R Red Fresh Concrete
Yellow Fresh Concrete

The invention claimed is:

1. A concrete block producing device comprising:

a concrete hopper:

a block machine having a stone mould that can be fed with fresh concrete from the concrete hopper;

a dosing device configured to fill the concrete hopper in a controlled manner with portions of at least two differently coloured fresh concretes, the dosing device having at least two dosing chambers and a transport device to transport the differently coloured fresh concrete portions to the concrete hopper;

wherein the transport device has at least one positioning element for receiving and guiding the coloured fresh concrete from the dosing chambers into the concrete hopper that is at least partially arranged at or in the concrete hopper wherein the positioning element is configured as an at least partially downwards extending positioning duct fixed at an end turned away from the concrete hopper and includes at least one of a flexible tube, telescopic pipe and pipe swivelable about the fixed end for being fed and the end of the positioning duct facing the hopper side is configured to be positioned about the internal base area of the concrete hopper by a movement lying in a substantially vertical plane for feeding differently coloured fresh concrete portions at predetermined positions in the concrete hopper.

2. The concrete block producing device according to claim 1, wherein the dosing device is arranged above the concrete hopper at the block machine.

3. The concrete block producing device according to claim 1, wherein at a hopper-side end of the positioning duct at least one guiding member is arranged that can be moved in a horizontal guide that is arranged in or in the vicinity of the concrete hopper.

4. The concrete block producing device according to claim 3, wherein the guiding member at the hopper-side end of the positioning duct is formed as a slide.

5. The concrete block producing device according to claim 1, wherein the transport device on at least one dosing chamber has a feeder duct with which fresh concrete can be inserted from the respective dosing chamber into the positioning duct.

6. The concrete block producing device according to claim 1, wherein the positioning duct at an upper end has a funnel for receiving the fresh concrete.

7. The concrete block producing device according to claim 1, wherein the positioning duct is directly or indirectly attached to a frame of the block machine.

8. The concrete block producing device according to claim 1, wherein the dosing chambers have dosing elements that at least one of slidably and swiveably close.

9. The concrete block producing device according to claim 5, wherein the feeder duct is formed as at least one of a belt conveyor and a pipeline.

10. The concrete block producing device according to claim 5, wherein the feeder duct has a conveyor that includes at least one of a worm drive, a rotor, pushers, and pistons.

11. The concrete block producing device according to claim 1, wherein at least one of the dosing device and the transport device have a nonstick coating on at least one contact surface between the fresh concrete and the respective device.

12. A method for producing coloured concrete blocks using a concrete block producing device, the method comprising:

moving a positioning element configured as a partially downwards extending positioning duct at or in a concrete hopper for selectively guiding coloured fresh concrete portions from at least two dosing chambers into the concrete hopper, wherein the positioning duct is fixed at an end turned away from the concrete hopper, wherein the hopper-side end of the positioning duct can be positioned about an internal base area of the concrete hopper using a movement lying in a substantially vertical plane; and dosing at least one fresh concrete portion and transporting the same into the positioning element.

13. The method according to claim 12, further including moving the hopper-side end of the positioning duct above the internal base area of the concrete hopper in a substantially vertical plane.

14. The method according to claim 12, further including repeating the positioning and dosing operation until the concrete hopper is filled with coloured fresh concrete portions up to a predetermined level.

15. The method according to claim 12, further including producing different colour patterns by at least one of:

varying at least one of an order and a duration of the dosing operation and;

mixing at least two coloured fresh concretes by simultaneously dosing from at least two dosing chambers.

16. The method according to claim 12, further including producing different colour patterns by varying the positions of the fresh concrete portions in the concrete hopper.

* * * * *